United States Patent [19]

Spannlang et al.

[11] 4,000,553

[45] Jan. 4, 1977

[54] ROLLER OR ROLL ASSEMBLY

[75] Inventors: Ronald Spannlang, Linz; Franz Kagerhuber, Traun, both of Austria

[73] Assignee: Vereinigte Osterreichische Eisen- und Stahlwerke - Alpine Montan Aktiengesellschaft, Linz, Austria

[22] Filed: Oct. 20, 1975

[21] Appl. No.: 624,064

[30] Foreign Application Priority Data

Oct. 22, 1974 Austria ..... 8480/74

[52] U.S. Cl. ..... 29/115; 29/116 AD; 29/129.5

[51] Int. Cl.[2] ..... B21B 13/02

[58] Field of Search ..... 29/110, 113 AD, 115, 29/116 AD, 121 R, 121 A, 125, 129.5

[56] References Cited

UNITED STATES PATENTS

| | | | |
|---|---|---|---|
| 392,484 | 11/1888 | Zdziarski | 29/121 R |
| 1,117,022 | 11/1914 | Galgon | 29/110 |
| 1,820,074 | 8/1931 | Kilborn | 29/110 X |
| 1,829,738 | 11/1931 | Cone et al. | 29/125 X |
| 2,527,811 | 10/1950 | Hall | 29/125 X |
| 3,353,757 | 11/1967 | Coffman | 29/121 R X |
| 3,588,978 | 6/1971 | Brafford | 29/121 R |
| 3,736,869 | 6/1973 | Motter et al. | 29/116 AD X |

*Primary Examiner*—Alfred R. Guest
*Attorney, Agent, or Firm*—Brumbaugh, Graves, Donohue & Raymond

[57] ABSTRACT

A continuous casting plant has rollers or rolls for supporting, guiding, bending and straightening or deforming a wide strand, which rollers or rolls have annular recesses distributed over their longitudinal extensions forming bearing pins that are received in two outer bearings and at least one inner bearing arranged therebetween. One of the outer bearings acts as a fixed bearing, while all the other bearings act as expansion bearings.

8 Claims, 5 Drawing Figures

ROLLER OR ROLL ASSEMBLY

BACKGROUND OF THE INVENTION

The invention relates to a continuous casting plant with rollers or rolls for supporting, guiding, bending, straightening and deforming a wide continously cast strand, in particular a steel slab with a width of more than 1,000 mm.

In the continuous casting of steel strands, in particular in the casting of slabs with widths of 1,000 to 2,500 mm, underneath the water-cooled mould numerous supporting rollers have to be arranged as close to one another as possible, in order to inhibit a bulging of the strand skin caused by the ferrostatic pressure of the liquid core of the strand. It has been shown in practice that such deformations of the strand skin, in particular when rollers with relatively wide diameters are used, lead to cracks and thus to a lessening of the quality of the cast product. The problem of the supporting of the strand skin becomes especially critical when a high casting speed (extraction speed of the strand) is necessary. Such so-called rapid casting plants with a casting speed of more than about 1.2 m/min, e.g. with 1.6 to 2 m/min, require special care in the construction and maintenance of the whole supporting and guiding roller construction, since with an increasing casting speed the need for precise support of the strand increases and the extraction force on the cast strand increases accordingly.

Known continuous casting plants have the disadvantage that the cooling is effected exclusively by the spraying of cooling water onto the strand from the outside. When the spraying nozzles are out of order, e.g. when they are clogged by impurities, there is the danger of over-heating so that on the rollers and in the bearing elements, temperatures of more than 700° C can occur which cause the bearing grease to coke and the bearing to become blocked. Furthermore, when such a disturbance occurs, a high increase in the extraction force is necessary, which may lead to cracks.

Further difficulties in known plants arose due to the fact that the individual rollers arranged adjacent one another could not be driven for reasons of construction, and therefore the extraction forces were applied to the strand by special driving strands with rolls having wide diameters. When a number of drive stands are arranged at intervals between the non-driven supporting rollers, the danger of undue expansions of the strand skin exists at the transition places.

In order to overcome such difficulties, a proposal not yet belonging to the prior art consists in that the rollers or rolls are provided with internal cooling and are arranged in a number of bearings, whose bearing height, taken from the center of the bearing in the direction towards the strand skin, is smaller than the radius of the roller body. The internal cooling is to be effected by a coolant pipe concentrically arranged in an axial bore of the roller body, whereby a coolant circuit is formed. Furthermore, each one of the rollers or rolls is to be directly driven in order to prevent individual rollers from coming to a stand-still in case of a distortion, from being warmed up unevenly and from being destroyed thereby.

SUMMARY OF THE INVENTION

The invention has as its object to further improve continuous casting plants with rollers or rolls in slide bearings, wherein a number of bearings are arranged over the longitudinal extension of the rollers or rolls, which rollers or rolls advantageously are provided with an internal cooling and separate drives.

In particular the invention has as its object to make the roller or roll bearings, respectively, meet the following demands:

1. The rollers must be quickly exchangeable;
2. Apart from the radial stresses arising from the ferrostatic pressure, the adjustment pressure and the weight of the strand, the roller bearing must also be able to accommodate axial stresses occurring for instance in a slight lateral sliding of the strand in the direction of the roller axis;
3. The bearing must be able to accommodate thermal expansions of the rollers without impairing the sealing of the bearing. When the roller is 2 m long and when there is a temperature difference between the roller and the supporting construction of about 700° C, the thermal expansions may amount to up to 15 mm;
4. The bearings have to be and remain completely sealed against cinders falling down from the strand onto the bearing. The effectiveness of the bearing sealing must not be impaired by a wear of the radial and axial bearing elements;
5. The parts of the bearing facing the strand must not be deformed or even destroyed by the heat influence originating from the strand;
6. It must be guaranteed that the individual radial bearing elements are subjected to an even wear in spite of differing radial stresses, in order that, on the one hand, the thickness of the strand along the width of the strand does not differ, and, on the other hand, the rollers are not subjected to additional bending stresses; and
7. Finally, the use of slide bearing materials that do not require a separate lubrication has to be guaranteed, since with the low sliding speeds the formation of a continuous film of the lubricant between the sliding faces is not possible and the lubricants would be prematurely destroyed due to the influence of the heat.

In a continuous casting plant of the above described kind, in which the roller or roll bodies have a number of annular recesses distributed over their longitudinal extensions, whereby cylindrical bearing pins are formed which are received in two outer bearings supported on the supporting construction and one or more inner bearings arranged therebetween, according to the invention these objects are achieved in that the bearing housing of the one outer bearing acting as a fixed bearing is axially held by an abutment secured to the supporting construction, that the bearing housings of the one or more further inner bearings acting as expansion bearings loosely rest on the supporting construction, and that the other outer bearing acting as an expansion bearing is arranged to be axially displaceable on the supporting construction and is held perpendicularly relative to the direction of displacement.

Advantageously, the bearing housings comprise a housing lower part, a bearing half-shell inserted therein, two stop half rings and a lid, wherein between the bearing half-shells and the lid, intermediate plates are introduced which are secured to the lower part of the housing by means of holding sleeves and fixing screws and which secure the bearing half-shells and the stop half rings against torsion.

Further advantageous features of the invention involve: expansion bearing plates provided between the bearing housings of the expansion bearings and the supporting construction; bearing lids of the bearing housings arranged floatingly, i.e. displaceable in axial and horizontal directions; heat-resistant and elastic sealings built in the side faces of the bearing lids facing the lateral plane faces of the annular roller body recesses; and the dimensioning of the slide faces of the bearing half-shells in a way that the product of bearing pressure x sliding speed is the same in all of the bearings.

In order to solve the problem of lubrication, all the sliding materials of the bearings, i.e. the expansion plates and the bearing half-shells, comprise self-lubricating bearing materials.

According to a preferred embodiment of the invention, in the bearing lower parts bores are provided for the introduction of gaseous media.

BRIEF DESCRIPTION OF THE DRAWINGS

The invention shall now be described by way of an example and with reference to the accompanying drawings, wherein.

DESCRIPTION OF AN EXEMPLARY EMODIMENT

Figure 1:
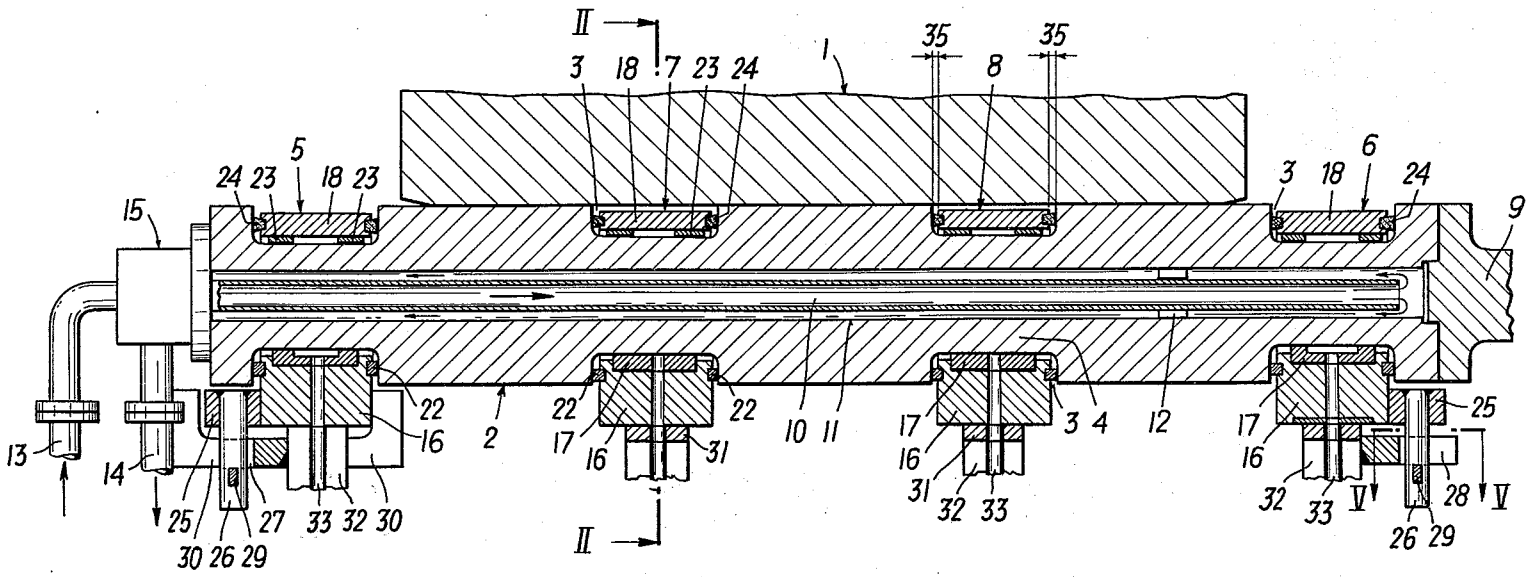
FIG. 1 is a longitudinal section through a roller and its support structure in a continuous casting plant.
Figure 2:
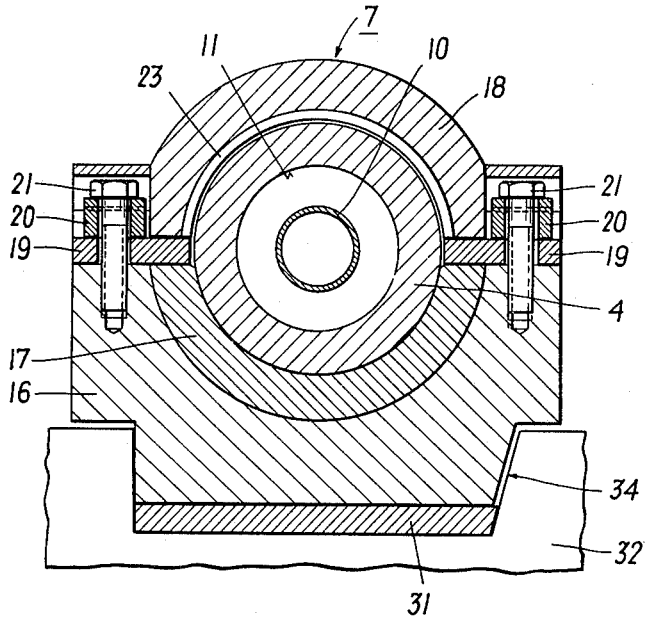
FIG. 2 is a cross-section of a bearing of a roller according to line II—II of FIG. 1.

In FIG. 1 a continuous casting slab, denoted with 1, rests on, or whose strand skin is supported by, the roller or roll 2. According to the invention, the roller has, along its longitudinal extension, a number of annular recesses 3, whereby cylindrical bearing pins 4 are formed. In these recesses a cylindrical face is created, for instance by hard chrome plating or by the spraying on of metals with subsequent grinding, so that the offset part of the roller body forms a bearing pin. The bearing pin 4 is surrounded by a bearing. In particular two outer bearings are provided which are denoted with 5 and 6, as well as two inner bearings which are denoted with 7 and 8. A drive flange 9 has a hydraulic motor (not shown), possibly together with intermediate gearing, detachably connected to it. The drive is defined by a torque support in the peripheral direction relative to the supporting construction. The roller or roll bodies are provided with internal cooling consisting of a water supply pipe 10 inserted into the axial bore 11 in order to form an annular space and supported by centering ribs 12. Cooling water supplied via a pipe 13 flows through the roller in the direction of the arrow and is drained via a pipe 14. A rotatable connection 15 connects the pipes to the roller internal cooling system. As shown in FIG. 2, each bearing (5, 6, 7 and 8) has a housing lower part 16, into which a bearing half-shell 17 is inserted, and a lid 18 which closes the housing. Between the bearing half-shell 17 and the lid 18, intermediate plates 19 are inserted which are held down via holding sleeves 20 by fixing screws 21 and which plates secure the bearing half-shell 17 against torsion.

Between the wall of the annular recess 3 and the bearing lower part 16, stop half rings 22 (FIG. 1) are inserted. Two bearing holding shells 23 are provided between the bearing pin 4 and the lid 18 to which they are also secured. Furthermore, in the side faces of the lid, heat-resistant and elastic sealings 24 are built in and protect the inside of the bearing from cinders falling down from the strand onto the bearing. The two outer bearings 5 and 6 have projections 25 from which holding bolts 26, via recesses 27, project through a holding flange 28 secured to the supporting construction, which holding bolts are secured at their back by means of a holding wedge 29.

The bearing 5 is a fixed bearing; its axial support is effected by the axially acting abutments 30 located on both sides of its housing and secured to the supporting construction. The expansion bearings (6, 7 and 8) are supported on expansion bearing plates 31 provided between the supporting construction 32 and the housing lower parts 16. Furthermore, bores 33 are provided in the housing lower parts 16, through which gaseous media can be introduced into the interior of the bearings.

The requirements laid out above for a continuous casting plant are excellently met by the plant according to the present invention.

In case of damage, the complete roller can be taken out of service easily by removing the holding wedge 29 from the holding bolt 26 and disconnecting the drive flange 9 as well as the supply and drain pipes 13 and 14. After that the roller can be lifted out of the receiving pocket 34 of the supporting construction (FIG. 2) and thus from the roller table. Then, in the opposite sequence, a spare roller can be substituted for the damaged roller immediately. Such an exchange can be carried out in less than an hour, whereas in known continuous casting plants, the removal of a roller — if possible at all — takes eight hours or longer.

Also, axial stresses are easily and satisfactorily accommodated with the present invention, since the axial stress of the roller in the fixed bearing 5 is transmitted, depending on the direction of the stress on one of the two plane faces of the roller recess 3, via the stop rings 22 and the lower part 16 of the bearing housing, onto one of the two abutments 30.

Figure 5:
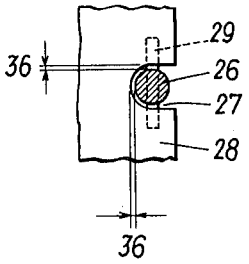
FIG. 5 is a detailed section of the mounting of the outer bearing along line V—V of FIG. 1.

The necessity of accommodating the thermal expansion of the roller is met in that the bearing housings 16 loosely rest on the expansion bearing plates 31 of the supporting construction and thereby are axially displaceable instead of being connected to the supporting construction, as used to be the common practice. In case of a thermal expansion of the roller, it is held in its position in its fixed bearing 5, which is supported by the abutments 30. The bearings 6, 7 and 8 are displaced as a whole in their bearing places according to the expansion of the roller. Thus it is possible that the play 35 (FIG. 1) between the plane faces of the roller recesses 3 and the bearings can be kept slight without having to take into consideration the expansion of the roller. This slight play 35 is the precondition for a uniformly effective sealing of the bearings in all expansion conditions. The holding elements 26, 28 and 29 have a play 36 in the expansion bearing (FIG. 5), so that this bearing, too, can be displaced together with the other ones without restraint. If, as previously has been the case, the bearing housings are fixedly connected to the supporting construction, the play has to be chosen as wide as the maximum possible roller expansion, i.e. about 15 mm, so that the roller cannot get jammed in the bearings. Since there is practically no heat-resistant sealing which can effectively seal a gap that changes greatly depending on the direction of the effect of the axial force, the solution provided by the present invention constitutes a significant improvement.

According to the invention the sealing problem is solved because the sealing is effected with a heat-proof soft sealing while the slight play 35 is maintained, hence the penetration of dirt is forestalled. An improvement of the sealing can also be achieved by introducing a gaseous media, such as air under pressure or steam, under pressure through the bores 33 into the bearing, which gaseous media counteracts the tendency for the penetration of dirt into the bearing. The sealings 24 built into the lid and acting against the plane faces of the roller recess, are not influenced by the wear of the radial bearing half-shells 17 and the stop half rings 22 during operation, because the wear of the bearing half-shells does not go hand-in-hand with a widening of the gap. This also constitutes a significant advance, since in a bearing lid connected with the bearing housing in the usual manner, the gap would decrease on one side and widen on the other side, depending on the direction of the axial stress. Since, under such conditions, the lateral play 35 of the lid on each side would have to be at least as wide as the possible axial bearing wear, in the course of a long operation the play would widen from 4 mm, e.g., to 8 mm while the axial stop rings are worn; such play can not be bridged with a heat-proof sealing.

Figure 3:
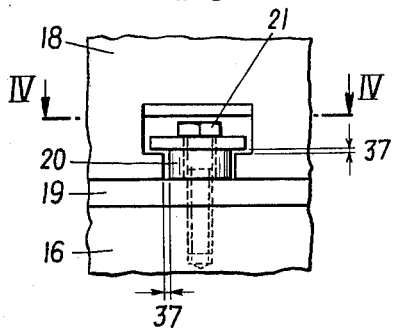
FIG. 3 is a side view of the mounting of a bearing lid.
Figure 4:
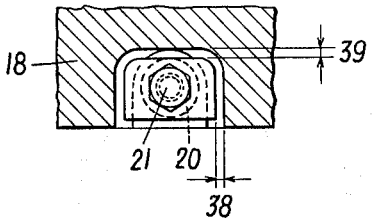
FIG. 4 is a detailed section along line IV—IV of FIG. 3.

In the bearing construction of the present invention the bearing lid 18 is arranged so as to float by having plays 37, 38 and 39 on all sides in the holding sleeves 20 (FIGS. 3, 4) so that it recedes under a slight axial pressure by the roller plane faces. On the other hand, the holding sleeve 20 has rims which prevent the bearing lid from falling off and thus the roller from falling out of the bearing construction when the rollers are hanging and the strand has been extracted. Also for this reason it is possible to choose a slight lateral play 35 of the lid, which is a particular precondition for a well-functioning sealing.

The further requirements for an operationally safe, simple and easily operable plant are also met. The bearing lid, which due to its position is the part most subjected to the heat influence, experiences a strong thermal expansion. This is not prevented by the floating arrangement and thermal tensions are avoided. A uniform wear of the radial bearing shells is achieved in that they are not — as usual — designed identically, but the sizes of the sliding faces of the individual bearings are chosen according to their loads in a way that in each bearing the product of the bearing pressure x bearing sliding speed is about equal.

As bearing materials self-lubricating bearing materials are used, which set free the packed-in heat-resistant lubricating agent, e.g. graphite, when the bearing metal is worn, This is then transported between the sliding faces due to the rotation, whereby a lasting, continuous lubricant film is created. The introduction of moisture-containing, gaseous flush media into the interior of the bearing in addition causes an improvement of the lubricating ability of the graphite-containing lubricant materials.

What we claim is:

1. A roller or roll assembly for supporting, guiding, bending, straightening or deforming a continuously cast strand of relatively great width, in particular a steel slab of a width exceeding 1,000 mm, in a continuous casting plant having a supporting construction, which roller or roll comprises annular recesses distributed over its longitudinal extension to form bearing pins of a substantially cylindrical shape, which assembly further comprises an outer fixed bearing having a bearing housing and accommodating one of said bearing pins, which outer fixed bearing is supported on the supporting construction, an abutment secured to the supporting construction and axially holding the bearing housing of said outer fixed bearing, an outer expansion bearing having a bearing housing and accommodating one of said bearing pins, which bearing is supported on the supporting construction and arranged for axial displacement thereon and held perpendicularly to the direction of displacement, at least one inner expansion bearing having a bearing housing and accommodating one of said bearing pins, which at least one inner expansion bearing is arranged between said outer fixed bearing and said outer expansion bearing and rests loosely on said supporting construction.

2. A roller or roll assembly as set forth in claim 1, wherein each of the bearing housings of the bearings accommodating the bearing pins formed by the annular recesses in the roller or roll comprises a housing lower part, a housing half-shell with a slide face inserted in the housing lower part, two stop half rings located between the sides of the lower housing and the recesses, a lid acting as a housing upper part, intermediate plates arranged between the bearing half-shell and the lid, and holding sleeves and fixing screws to secure the intermediate plates to the bearing lower part, the thus secured intermediate plates securing the bearing half-shell and the two stop half rings against torsion.

3. A roller or roll assembly as set forth in claim 1, further comprising expansion bearing plates arranged between the supporting construction and the respective bearing housings of the outer expansion bearing and the at least one inner expansion bearing.

4. A roller or roll assembly as set forth in claim 2, wherein the bearing lid of each of the bearing housings is arranged to be displaceable in axial and horizontal directions.

5. A roller or roll assembly as set forth in claim 2, wherein each of the annular recesses has plane side faces and wherein heat-resistant and elastic sealings are arranged between the plane side faces of the annular recess and the lid, the sealings being inserted in the lid where it faces the plane side faces of the annular recess.

6. A roller or roll assembly as set forth in claim 2, wherein the slide faces of the bearing half-shells are dimensioned in a way that the product of bearing pressure x sliding speed is the same in all bearings.

7. A roller or roll assembly as set forth in claim 1, wherein the bearings are slide bearings having slide parts made of a self-lubricating bearing material.

8. A roller or roll assembly as set forth in claim 2, further comprising bores in the housing lower parts for introducing gaseous media.

* * * * *